United States Patent [19]

Schoppee

[11] 4,006,577

[45] Feb. 8, 1977

[54] GUM STICK WRAPPING MACHINE

[75] Inventor: Lawrence W. Schoppee, Springfield, Mass.

[73] Assignee: Package Machinery Company, East Longmeadow, Mass.

[22] Filed: June 11, 1975

[21] Appl. No.: 586,092

[52] U.S. Cl. ..... 53/171; 53/176; 53/234; 225/104

[51] Int. Cl.² ..... B65B 11/36

[58] Field of Search ..... 53/171, 176, 234; 225/103, 104, 97

[56] References Cited

UNITED STATES PATENTS

| | | | |
|---|---|---|---|
| 1,060,983 | 5/1913 | Kempf | 53/234 X |
| 1,474,181 | 11/1923 | Steere | 53/176 X |
| 1,836,019 | 12/1931 | Evans et al. | 53/176 |
| 2,029,934 | 2/1936 | Milmoe | 53/234 X |
| 2,251,172 | 7/1941 | Smith et al. | 225/97 |
| 2,306,191 | 12/1942 | Saladin | 53/234 X |
| 2,954,655 | 10/1960 | Seragnoli | 53/234 |
| 3,099,375 | 7/1963 | Schoppee et al. | 225/97 |
| 3,439,473 | 4/1969 | Focke et al. | 53/234 |
| 3,890,766 | 6/1975 | Hatta | 53/234 |

*Primary Examiner*—Othell M. Simpson
*Assistant Examiner*—J. Sipos
*Attorney, Agent, or Firm*—McCormick, Paulding & Huber

[57] ABSTRACT

A single gum stick wrapping machine has a rotary transfer mechanism for successively conveying single sticks of gum from breaker wheels to a folding wheel where each stick picks up a wrapper and is conveyed through folding and creasing sections where the wrapper is partially folded around the stick and the ends of the wrapper are folded, creased and tucked. The wrapping operation is completed while the partially wrapped stick is conveyed from the folding wheel to a stacker at the discharge end of the machine by another rotary transfer mechanism. Rotary label wrapping mechanism may be provided for applying a label or outer wrapper to each stick.

26 Claims, 40 Drawing Figures

21A-J
19
20
22
23

DRIVER

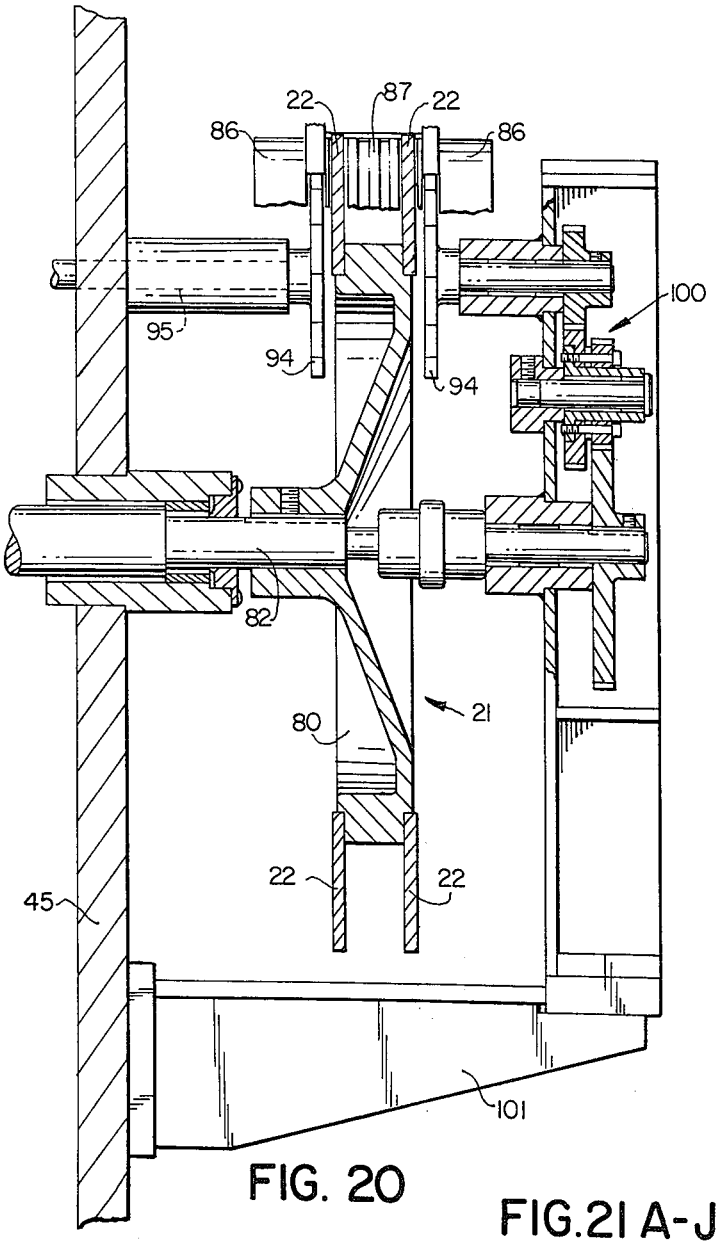
FIG. 20
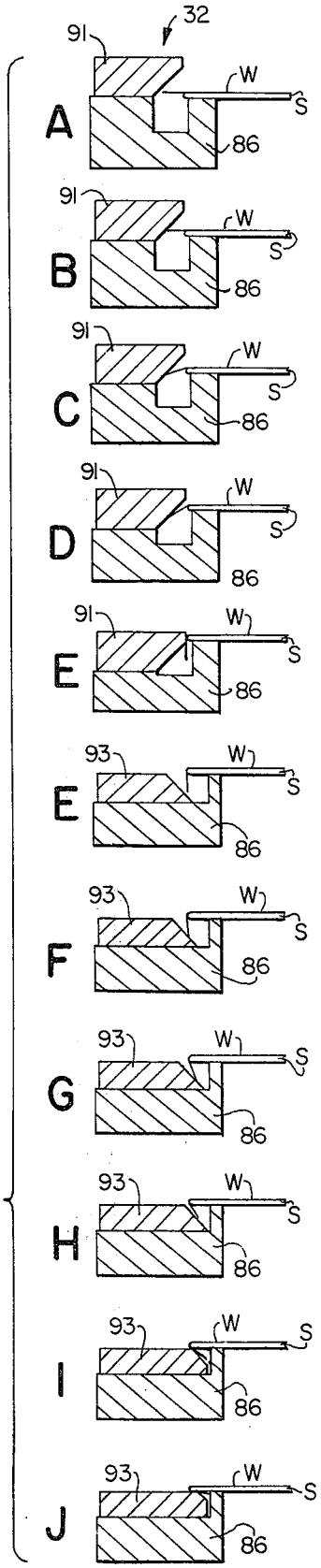
FIG.21 A-J
FIG. 30
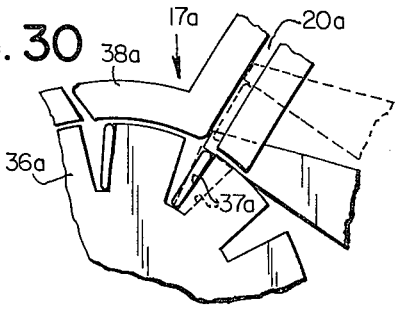

FIG. 24
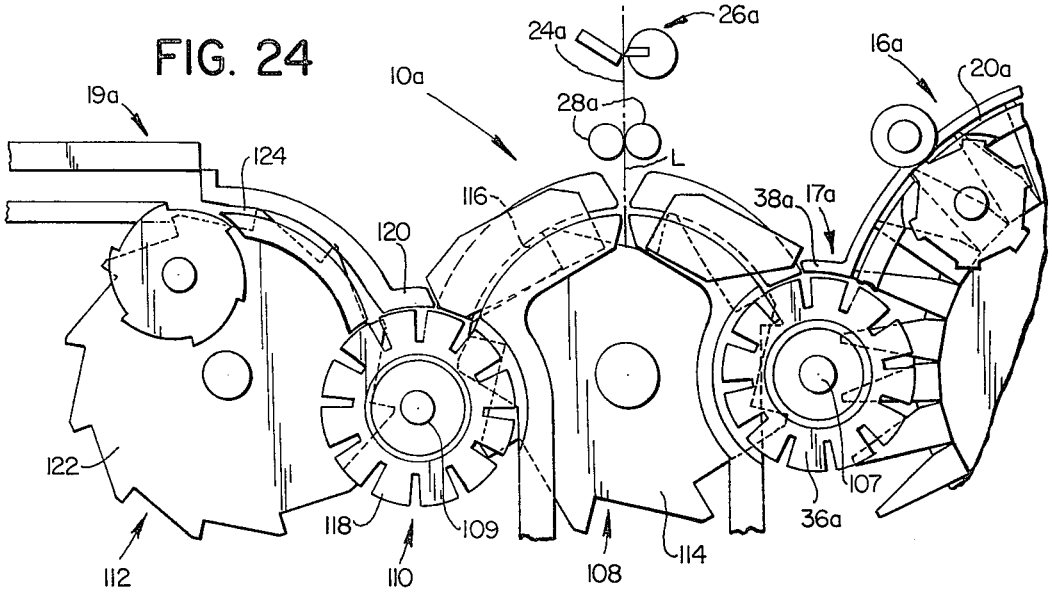
FIG. 29
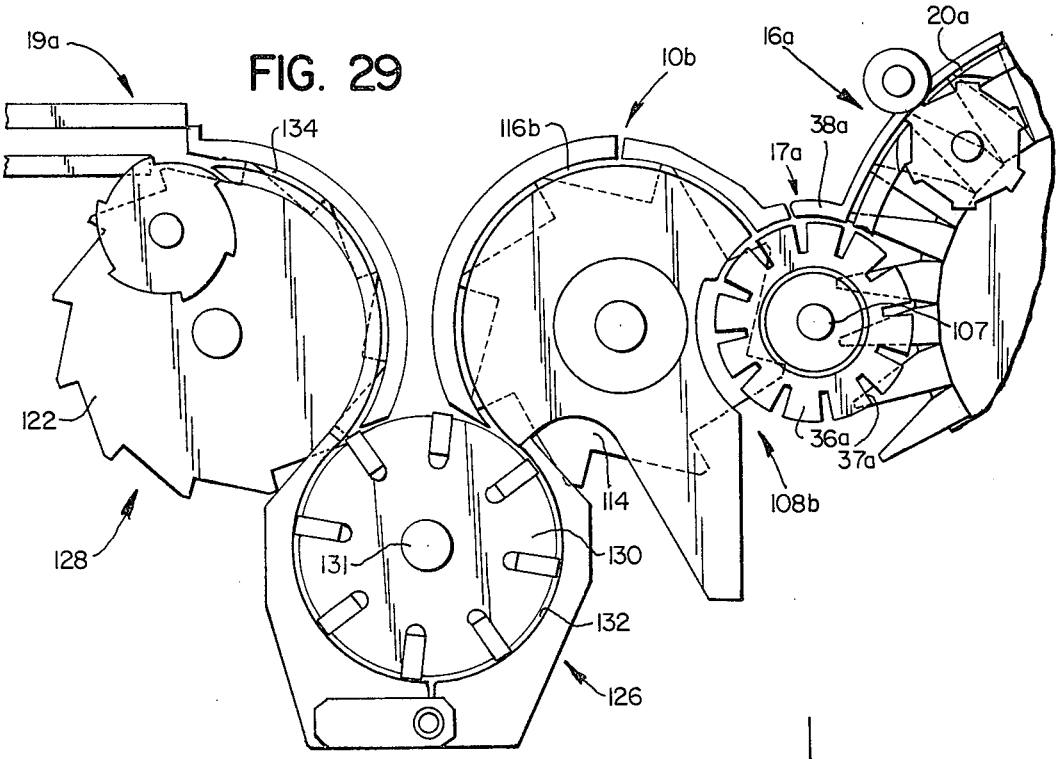
FIG. 27
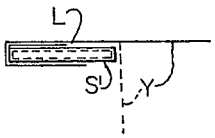
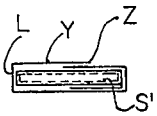
FIG. 28
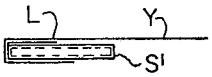
FIG. 26
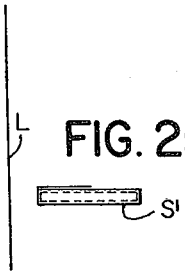
FIG. 25

GUM STICK WRAPPING MACHINE

BACKGROUND OF THE INVENTION

This invention relates in general to packaging machinery and deals more particularly with improved machines for wrapping individual articles of a flat stick-like nature, as for example, sticks of gum or the like.

The development of the improved automatic high speed apparatus and methods for feeding gum to wrapping machines has created the need for improved compatible high speed stick wrapping and packaging apparatus. Gum stick wrapping machines heretofore available have generally utilized reciprocating transfer mechanism which imposes some limitation on the ultimate speeds attainable by such machines. It is the general aim of the present invention to provide improved single stick wrapping machines utilizing rotary wrapping and conveying mechanism and wherein sticks are wrapped while being conveyed at high speed to a collection point, where wrapped sticks are or may be grouped as required, for further packaging.

SUMMARY OF THE INVENTION

In accordance with the present invention, an improved stick wrapping apparatus is provided which comprises a rotary transfer mechanism for receiving and successively advancing sticks, a rotary folding wheel for receiving each successive stick from the transfer mechanism and partially forming a wrapper therearound as the stick is conveyed by the folding wheel through folding and creasing sections, and another rotary transfer mechanism for successively receiving each partially wrapped stick from the folding wheel and completing the wrapping operation while conveying the stick to the discharge end of the machine.

BRIEF DESCRIPTION OF THE DRAWINGS

FIG. 20 is a somewhat enlarged fragmentary sectional view taken generally along the line 20—20 of FIG. 1.

FIG. 21 comprises a series of sectional views taken at equal intervals and in radial planes along the lines 21A–J of FIG. 1.

FIG. 24 is a fragmentary side elevational view of a gum machine and illustrates another embodiment of the invention.

FIGS. 25–28 are side elevational views diagramatically illustrating successive steps in the application of a label or outer wrapper to a single wrapped stick.

FIG. 29 is a fragmentary side elevational view of a modified form of the machine of FIG. 24.

FIG. 30 is a somewhat enlarged fragmentary side elevational view of the machine of FIG. 24.

DETAILED DESCRIPTION OF THE PREFERRED EMBODIMENTS

Figures 1, 3, 4, 5, 6, 7, 8, 9, 10:
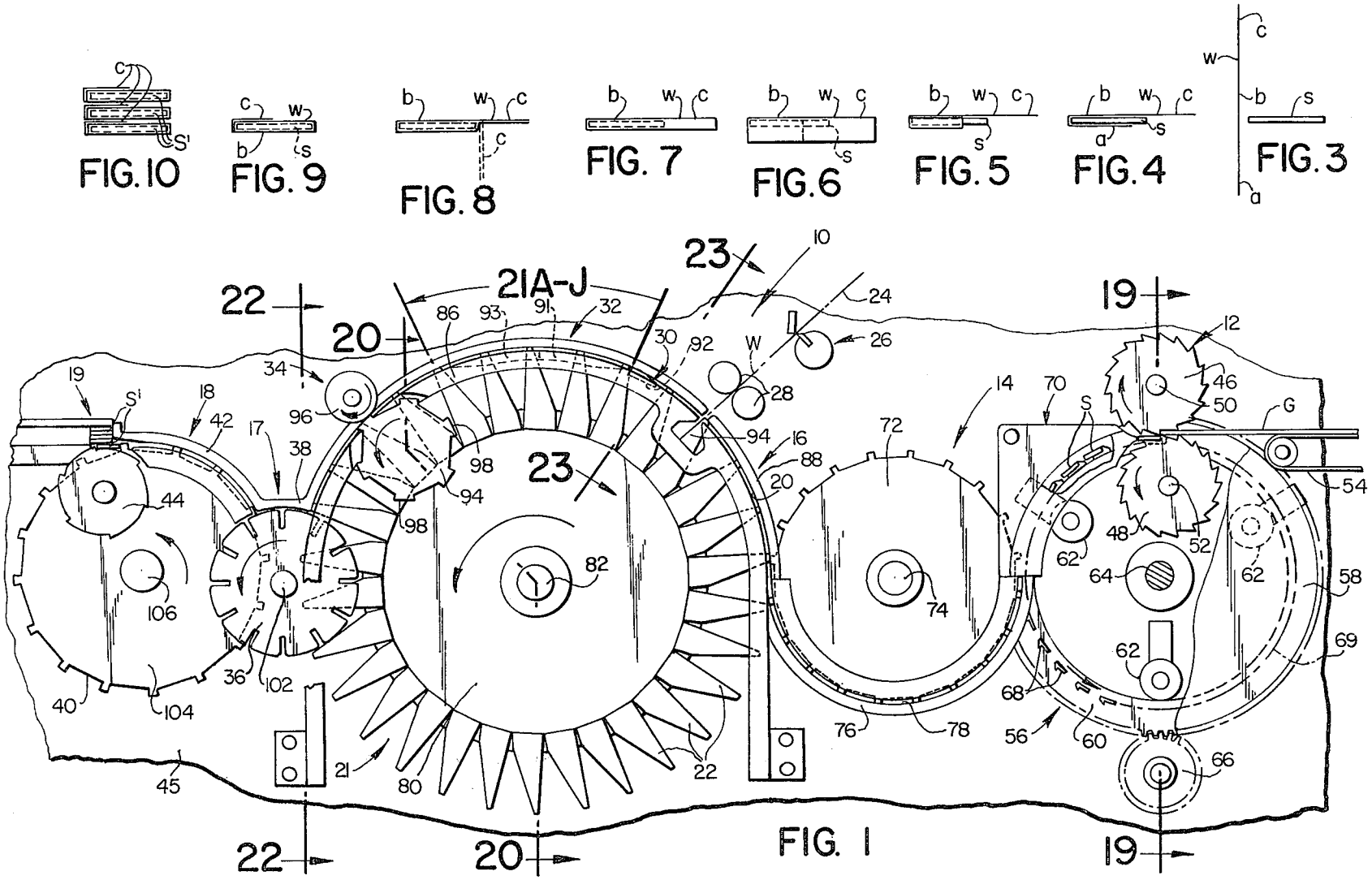
FIG. 1 is a somewhat schematic fragmentary side elevational view of a rotary gum stick wrapping machine embodying the present invention.
FIGS. 3–10 are side elevational views diagramatically illustrating successive steps in the wrapping of a single stick of gum.
Figures 2, 11, 12, 13, 14, 15, 16, 17, 18:
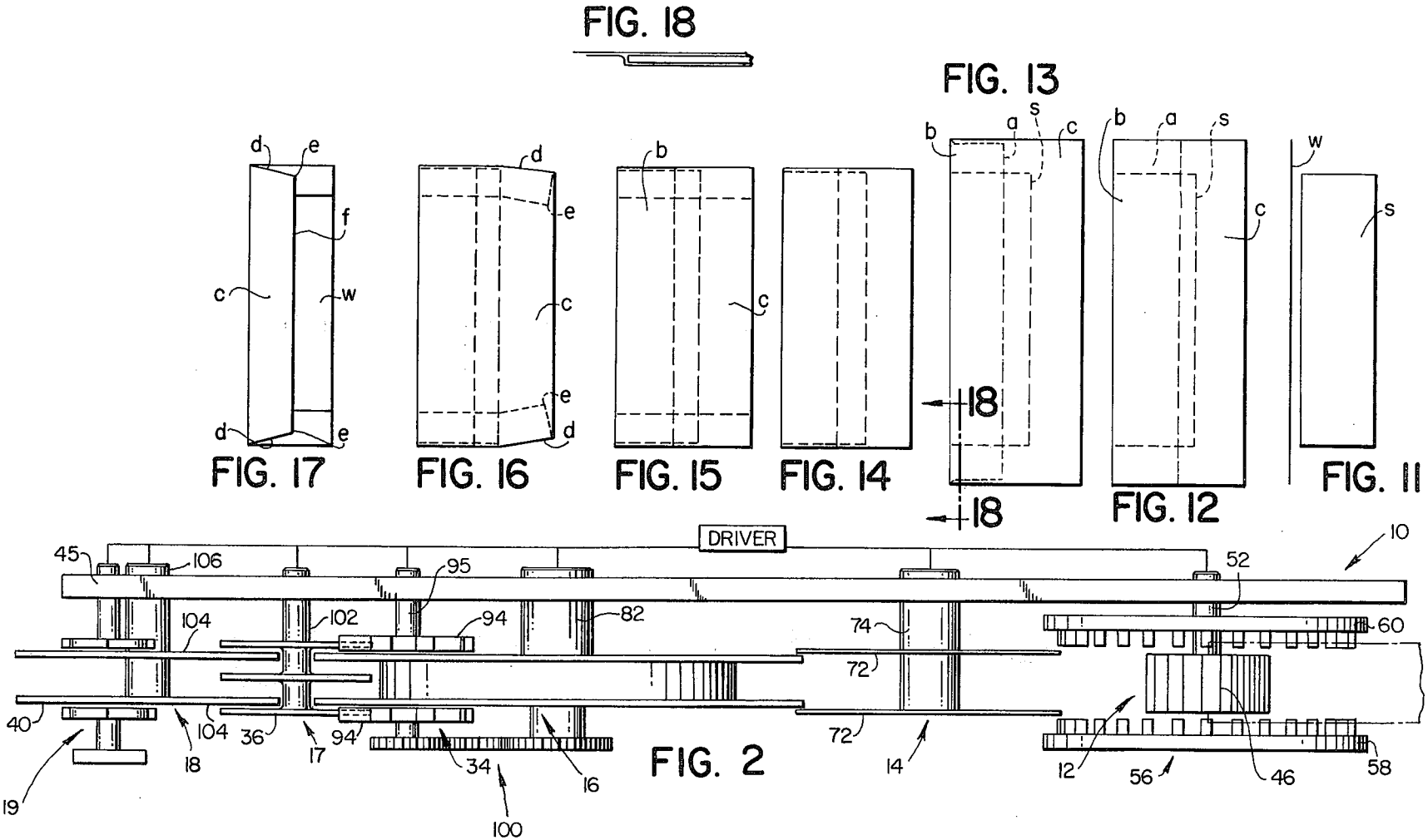
FIG. 2 is a fragmentary plan view of the machine of FIG. 1 and shows the relative positions of the various rotary elements, the channels and guide tracks not being shown.
FIGS. 11–17 are plan views diagramatically illustrating successive steps in the wrapping of a single stick of gum.
FIG. 18 is a sectional view taken along the line 18—18 of FIG. 13.

Turning now to the drawings, the diagramatic views of FIGS. 1 and 2 illustrate a rotary wrapping machine indicated generally at 10 and particularly adapted for wrapping individual sticks of gum or the like. The machine 10 comprises a breaker mechanism designated generally by the numeral 12 which receives a continuous supply of prescored slabs of gum, such as the slab G, and separates each slab along score lines into individual sticks S, S. The breaker mechanism 12 feeds the sticks S, S at spaced intervals to a transfer wheel, indicated generally at 14, which further conveys each stick along an arcuate path to a first rotary folder or folding wheel indicated generally at 16, where an inner wrapper W is applied to the stick. The folding wheel 16 also performs a series of folding and creasing operations on the wrapper to partially wrap the stick as it advances along a generally arcuate path. The machine 10 further includes second and third rotary folders, respectfully generally indicated at 17 and 18, which successively receive each partially wrapped stick and perform final wrapping operations thereon while further advancing each stick S along arcuate paths to the discharge end of the machine. A stacking mechanism 19 at the discharge end of the machine 10 receives and stacks successive wrapped sticks designated S′, S′ and delivers each successive stack to a package wrapping machine (not shown).

Before considering the machine 10 in further detail, the various parts and successive operations of the rotary folders 16, 17 and 18, as shown in FIGS. 1 and 2, may be best generally understood by also referring to FIGS. 3–18 which diagramatically illustrate successive operations for wrapping a single stick of gum S. The folding wheel 16 has an arcuate folding channel 20 which defines a path of gum stick travel and a rotary element, indicated generally at 21, which has a plurality of radially outwardly extending fingers or flights 22, 22 for engaging the gum sticks S, S within the channel 20 to convey the sticks therealong. As each stick S is advanced within the channel 20, a thin inner wrapper W, which may, for example, comprise foil-sulfite paper, is cut from a continuous web 24 by a rotary cutter indicated generally at 26 and positioned in the path of the stick S by a pair of feed rolls 28, 28 so that the leading edge portion of the advancing stick S engages the wrapper W, as shown in FIG. 3. Opposing inner and outer walls of the folding channel 20 engages the wrapper W to fold it to a generally U-shaped configuration about the advancing stick S and into the form shown in FIGS. 4 and 12. Referring to the latter figures, it will be noted that the lower end portion of the wrapper W, designated (*a*), is folded against the bottom face of the stick S and a mid-portion of the wrapper, designated (*b*), is folded against the top face of the stick S to cause the wrapper upper end portion (*c*) to trail behind the top face. It will be further noted that equal opposite side marginal portions of the wrapper W extend outwardly in axially opposite directions beyond the opposite ends of the stick S, as best shown in FIGS. 12 and 13. A pair of end folders 30, 30 mounted in fixed positions on the rotary folder 16 at opposite sides of the gum path defined by the channel 20 engage the extending side marginal portions of the wrapper W to fold the latter marginal portions upwardly against opposite ends of the stick S and against the lower face of the wrapper mid-portion (*b*). A typical side fold, as formed on the wrapper W by an end folder 30 is best shown in FIG. 18. Spiral folders 32, 32 mounted in fixed positions at opposite sides of the channel 20 then contact the outwardly extending side marginal portions of the wrapper W and fold the outwardly extending side marginal portions of the wrapper downwardly relative to the stick S and against opposite ends of the stick as shown in FIGS. 6 and 14. The spiral folders 32, 32 also tuck the downwardly folded side marginal extensions inwardly so that portions of these extensions overlie the lower face of the wrapper portion (*a*). The machine 10 also includes rotary folding and creasing mechanism indicated generally at 34 which engages the trailing portions of the wrapper W and tucks the inwardly folded side marginal extensions of the wrapper portion (*c*) upwardly against the trailing edge of the stick S and creases the folds at the outer edges of the trailing portion, the latter folds being indicated at (*d*, *d*) (FIG. 16) as the stick S is further advanced within the channel 20 by flights 22, 22. This folding and creasing operation brings corners (*e*, *e*) of the wrapper end portion (*b*) inwardly, as shown in FIG. 16. After the partially wrapped stick S has advanced beyond the creasing mechanism 34, the wrapper W has the form substantially shown in FIGS. 8 and 16 and is discharged from the folding wheel 16 and leaves the channel 20 in the latter form.

The second rotary folder 17 comprises a pocket wheel 36, receives each partially wrapped stick from the folding wheel 16 and conveys it along another arcuate path. The pocket wheel 36 cooperates with a stationary folding element 38 which engages the wrapper trailing end portion (*c*) and folds it downwardly relative to the stick and against the trailing edge thereof to the broken line position of FIG. 8, as the pocket wheel 36 rotates relative to the folding element 38.

The third rotary folder 18 comprises transfer wheel 40 which receives each partially wrapped stick from the pocket wheel 36 and further advances it along another arcuate path. The third rotary folder 18 further includes another stationary folding member 42 which engages the wrapper trailing portion (*c*) to fold it inwardly below the lower face of the stick S as it is further advanced by the transfer wheel 40. Thus, the rotary folder 18 forms the final or long seam to complete the stick wrapping operation. The transfer wheel 40 successively delivers wrapped sticks S′, S′ to the stacker 19 in bottom-up position with the exposed edge (*f*) of the long seam in trailing position. The stacker 19 has a ratchet wheel 44 which elevates each wrapped stick S′ received therein to permit the next successive stick S′ delivered by the transfer wheel 40 to be inserted thereunder. Thus, each wrapped stick S′ is delivered to the stacker 19 with its exposed edge (*f*) in trailing position to minimize the risk of damage to this exposed edge as each stick S′ is fed into the stacker below a preceding one.

Considering now the structure of the machine 10 in somewhat further detail, the machine has a frame which comprises a generally vertically disposed plate 45. The breaker mechanism 12 comprises upper and lower toothed gum breaker wheels 46 and 48 respectively mounted on upper and lower shafts 50 and 52 journalled on the frame 45. A slab guide track (not shown) horizontally aligned with the nip between the breaker wheels 46 and 48 is preferably provided to guide prescored gum slabs, such as the slab G (FIG. 1), into the nip from a slab feed conveyor 54. The breaker mechanism 12 further includes a breaker transfer conveyor indicated generally at 56 which receives sticks S, S separated from the slab G by the breaker wheels 46 and 48 and conveys the sticks along an arcuate path away from the breaker wheels and in spaced relation to each other, as shown in FIG. 1.

Figure 19:
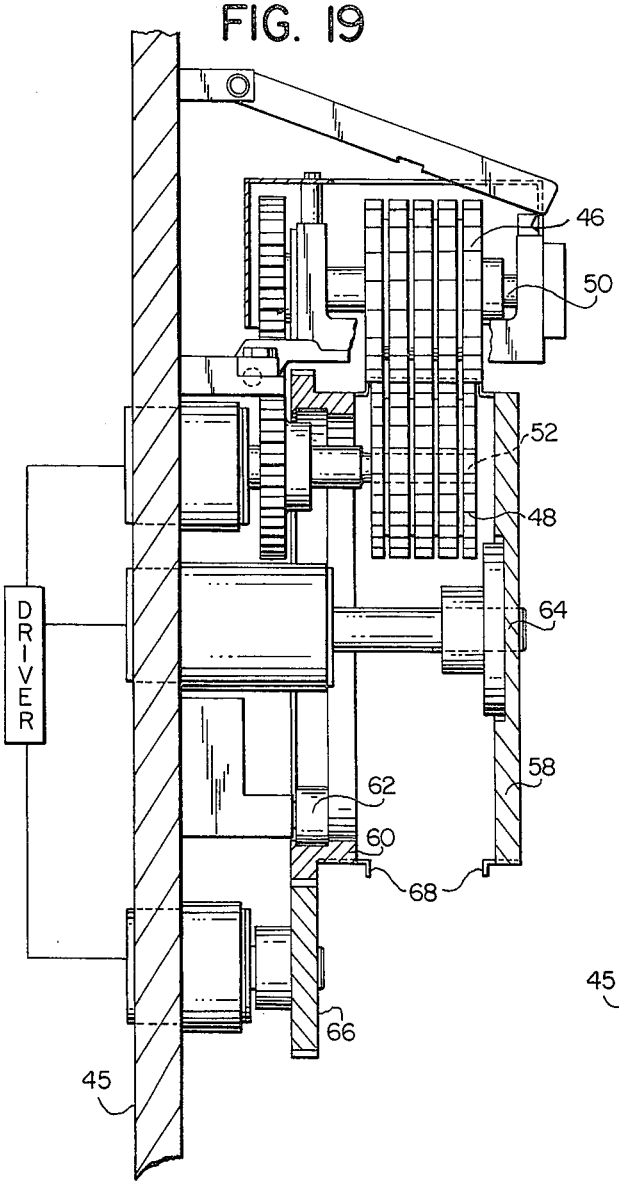
FIG. 19 is a somewhat enlarged fragmentary sectional view taken along the line 19—19 of FIG. 1.
Figure 22:
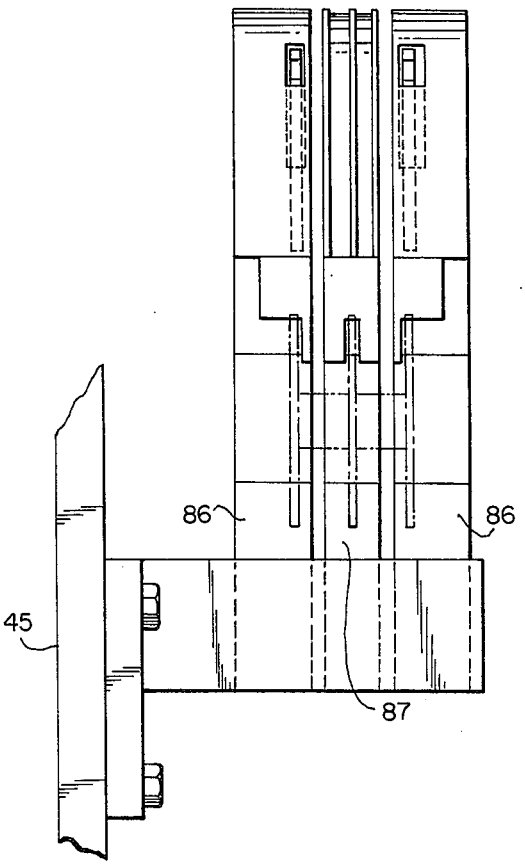
FIG. 22 is a somewhat enlarged fragmentary sectional view taken along the line 22—22 of FIG. 1.

The breaker transfer conveyor 56 includes a circular outer plate 58 and an annular inner ring 60 supported for simultaneous coaxial rotation relative to the frame 45 about an axis parallel to the axes of the breaker wheels 46 and 48. The inner ring 60 preferably comprises a ring gear supported at its inner peripheral surface by a plurality of rollers 62, 62 carried by spider arms mounted in fixed position on the frame 45, as generally shown in FIGS. 1 and 19. The outer plate 58 is supported on a central shaft 64 which extends coaxially through the central opening in the ring gear 60 and is driven in timed relation with the breaker wheels 46 and 48. A pinion 66 engages teeth on the outer periphery of the ring gear 60 to drive it in timed relation with the outer plate 58. The plate 58 and the ring gear 60 respectively carry a plurality of circumaxially spaced and axially opposed gum stick carrier elements 68, 68 which travel in a circular path designated by the numeral 69 and passing generally through the nip between the breaker wheels 46 and 48. The carrier elements 68, 68 carry gum sticks S, S, separated by the breaker wheels 46 and 48 which are supported between the plate 58 and the ring gear 60, as best shown in FIG. 19. It will now be evident that the ring gear 60 is employed and supported in the manner aforedescribed to accommodate the shaft 52 which carries the lower breaker wheel 48. A plurality of axially spaced apart and arcuately contoured inner and outer guide plates 70, 70 supported on the frame 45 generally define an arcuate guide track for containing gum sticks S, S conveyed away from the breaker wheels by the transfer conveyor 56.

The transfer wheel 14 comprises a pair of toothed discs 72, 72 mounted in axially spaced relation on a shaft 74 and disposed with the toothed peripheral edges thereof between the ring gear 60 and the plate 58, as best shown in FIG. 2. The transfer wheel 14 is driven in timed relation with the breaker transfer conveyor 56 and further includes a plurality of axially spaced apart guide plates 76, 76 which cooperate with the lower halves of the toothed discs 72, 72 to define an arcuate guide track 78 which provides a path of gum stick travel from the breaker transfer conveyor 56 to the folding wheel 16. The guide plates 76, 76 are preferably pivotally mounted on the frame 45, held in position by a latch or the like (not shown), and arranged to pivot away from the discs 72, 72 to facilitate clearing feed jams which may occur in the track 78.

Figure 23:
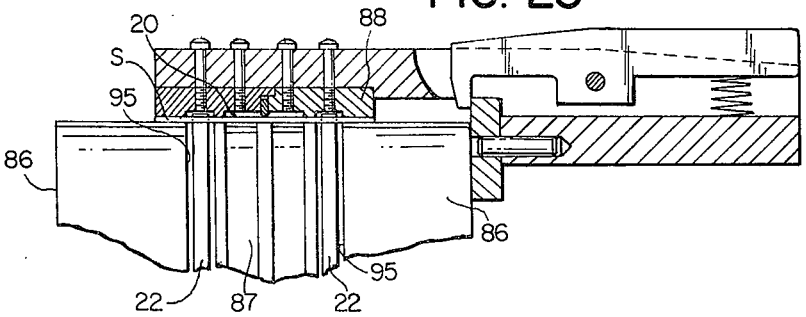
FIG. 23 is a somewhat enlarged fragmentary sectional view taken along the line 23—23 of FIG. 1 and shows a typical section through the first folding channel.

Further considering the folding wheel 16, and referring particularly to FIGS. 1 and 20, the rotary element 21 comprises a circular disc 80 journalled for coaxial rotation on the frame 45 by a shaft 82 and driven in timed relation with the transfer wheel 14. The flights 22, 22 are mounted in pairs on axially opposite sides of the disc 80 and extend radially outwardly therefrom substantially as shown in FIG. 1. The folding wheel 16, further includes a plurality of axially spaced apart generally semi-circular bottom gum supports 86, 86 and 87, the ends of which are mounted in fixed position on the frame 45 below the center of the wheel. The bottom gum supports extend around the upper portion of the folding element 21 to partially define the arcuate channel 20 which has its center of curvature coincident with the axis of the shaft 82. The channel 20 communicates with and forms the continuation of the guide track 78 and is further defined by a plurality of removable top plates a typical top plate being indicated at 88 in FIG. 23, wherein a typical cross section through the channel 20 is illustrated. The removable top plates such as the section 88 are preferably releasably retained in assembly with the bottom gum supports 86, 86 and 87 by spring latches or other suitable retaining means to permit access to the channel 20 to facilitate removal of damaged gum sticks or the like from the channel. The channel opening 20 is preferably adjustable to assure smooth passage of gum sticks therethrough. In the illustrated embodiment, the removable top plates 88, 88 may be adjusted generally toward or away from the bottom gum supports 86, 86 and 87 to adjust gum stick clearance as required. The flights 22, 22 are disposed within slots 95, 95 defined by the spaced bottom gum supports 86, 86 and 87, as best shown in FIG. 23, to engage gum sticks within the channel 20. A radially outwardly opening recess 94 formed in the top plates as shown in FIG. 1, receives the inner wrapper W fed by the feed rolls 28, 28 to a position across the channel 20 and into the path of an advancing stick S.

The end folders 30, 30 comprise a pair of blocks 92, 92 mounted on the bottom gum supports 86, 86 at opposite sides of the channel 20 and define converging slots which receive the extending side marginal portions of the wrapper W. The lower wall of each slot is defined by a block 92 and inclined upwardly and in the direction of gum travel, or in a counterclockwise direction as shown in FIG. 1. The spiral folders 32, 32 comprise another set of blocks 91, 91 and 93, 93 mounted on the bottom gum supports 86, 86. The inner ends of the blocks 91 and 93 are contoured to engage the outwardly extending side marginal portions of the inner wrapper W and fold it down against the opposite ends of the stick S and to tuck it in below the bottom surface of the stick as previously described. The spiral folders, best shown in FIGS. 1 and 21 are located immediately after the end folders 30. In FIG. 21, sections A–J, typical sections through the channel 20 taken at substantially equal intervals in radial planes along the lines A–J in FIG. 1 generally illustrate the folding sequence of a typical end fold as a partially wrapped stick S is advanced within the channel 20 by flights 22, 22. The illustrated blocks 91 and 93 are arranged in abutting end to end relation at one side of the channel, the sections E, E being taken at the abutting ends of adjacent blocks 91 and 93.

Referring now particularly to FIGS. 1, 2 and 20, the rotary folding and creasing mechanism 34 is mounted on the frame 45 and associated with the folding wheel 16 to engage the trailing marginal portions of partially wrapped gum sticks S, S advancing in the channel 20 and comprises a pair of creasing wheels 94, 94 and a pair of backup wheels such as the backup wheel indicated at 96 in FIG. 1. Each creasing wheel 94 has a circumaxially spaced series of arcuate peripheral segments which define creasing shoes 98, 98 on the outer peripheral surface thereof for in-running relation with the peripheral surface of an associated backup wheel 96 as best shown in FIG. 1. The creasing shoes 98, 98 are spaced so as to engage only the trailing marginal portions of an inner wrapper W to fold and crease the latter portions against the trailing edge of the stick and along edges *d, d* (FIG. 16) as the stick is conveyed through the creasing rolls by flights 22, 22. Referring now particularly to FIG. 20, the inboard creasing wheel 94 is supported adjacent the inboard or frame side of the rotary element 21 and driven in timed relation therewith by a shaft 95 journalled on the frame 45. The outboard creasing wheel 94 is driven in timed relation with the rotary element 21 through a gear train indicated generally at 100 coupled to the outer end of the shaft 82 and supported adjacent the outboard side of the rotary element 21 by a bracket assembly mounted on the frame 45 and indicated at 101 (FIG. 20).

The second rotary folder 17 includes the pocket wheel 36 which comprises three axially spaced apart discs supported on a shaft 102 and which has radially outwardly opening slots therein which form pockets for alignment with the channel 20 to receive each partially wrapped stick as it leaves the folding wheel 16. The pocket wheel 36 is preferably continuously rotated at continuously varying speed by the shaft 102 and in timed relation with the folding wheel 16 to receive each successive partially wrapped stick S as it leaves the folding wheel. The stationary folding element 38 comprises a top plate which complements an arcuate upper portion of the pocket wheel 36 to engage the trailing end portion (*c*) of an inner wrapper W as the pocket wheel 36 rotates in a counterclockwise direction (FIG. 1) to fold the trailing end portion from its full line to its broken line position of FIG. 8, as previously discussed.

The transfer wheel 40 of the third rotary folder 18 comprises a pair of spaced apart tooth discs 104, 104 supported for simultaneous coaxial rotation by a shaft 106 journalled on the frame 45 and driven in timed relation with the pocket wheel 36. The transfer wheel 40 receives each successive partially wrapped stick S from the pocket wheel 36 and conveys it in a counterclockwise direction as shown in FIG. 1 to the stacking mechanism 19. The stationary folder 42 comprises an arcuate plate which complements an associated upper peripheral portion of the transfer wheel 40 and engages the trailing end *c* in its broken line position of FIG. 8 and folds it inwardly against the lower surface of the stick S to its position in FIG. 9 as the stick moves out of the transfer wheel 36 and into the track formed by the folder 42. The transfer wheel 40 delivers each successive wrapped stick designated S′ to the discharge end of the machine and inserts it into the stacking mechanism 19 in a bottom up position with the exposed edge (*f*) of its long seam in trailing position as previously discussed. The stacking mechanism is or may be arranged to advance each stack, which comprises a predetermined number of sticks, to a package wrapping machine (not shown), or to collect the sticks in a single stack. If desired, the stacking mechanism may be eliminated whereupon the sticks may be successively discharged from the machine 10 in in-line relation.

It is sometimes required that an outer wrapper or label be applied to each wrapped stick before it is packaged. In FIG. 24 there is shown another machine embodying the invention and indicated by the reference numeral 10*a* which continuously advances sticks and which includes a section for applying an outer wrapper of label L to a wrapped stick. The machine 10*a* has a rotary folding wheel 16*a* substantially identical to the folding wheel 16 previously described and a second rotary folder 17*a* similar to the rotary folder 17 of the previously described embodiment. The folder 17*a* includes a pocket wheel 36*a* for receiving each successive stick discharged from the first folding channel 20*a*. The pocket wheel 36*a* is preferably supported for continuous rotation at continuously varying speed by a drive shaft 107, as may be required, and has a plurality of radially outwardly opening stick receiving pockets 37*a*, 37*a*. A typical pocket 37*a*, as shown in FIG. 30, diverges radially outwardly to provide a relatively wide entrance mouth for receiving a stick from the channel 20*a*. This pocket arrangement permits sticks to be fed from the folding channel 20*a* into the pockets 37*a*, 37*a* while the pocket wheel 36*a* is in motion. When the machine 10*a* is operated it may be necessary to rotate the pocket wheel 36*a* at continuously variable speed to permit sticks to be inserted into and removed from the pockets 37*a*, 37*a*, the wheel 36*a* being rotated at slower speed during the insertion and removal portion of the pocket wheel cycle than during the transfer portion thereof. A stationary folder 38*a* cooperates with the pocket wheel 36*a* to fold the inner wrapper trailing end portion (*c*) against the trailing edge of the stick S and from its full to its broken line position of FIG. 8, in the manner aforedescribed, as each partially wrapped stick S is further advanced by the folder 17*a*.

The label section comprises third, fourth and fifth rotary folders respectively generally indicated at 108, 110 and 112, receives the partially wrapped stick S from the pocket wheel 36*a*, completes the wrapping operation on the inner wrapper W and applies an outer wrapper or label L to the wrapped stick S′ while advancing it to a stacker 19*a* at the discharge end of the machine. The third rotary folder 108 includes a rotary element or transfer wheel 114 and a plurality of stationary top plates which extend around the upper portion of the transfer wheel 114 to define an arcuate folding channel 116 which has its center of curvature coincident with the axis of the transfer wheel. The transfer wheel 114 picks each partially wrapped stick from the rotating pocket wheel 36*a* and further advances it within the second folding channel 116. As the partially wrapped stick enters the channel 116, the inner wrapper trailingend portion (*c*) is folded from its broken line position of FIG. 8 to its full line position of FIG. 9 thereby completing the inner wrapper long seam.

A label L cut from a continuous web 24*a* by a rotary cutter 26*a* is fed into the path of the advancing wrapped stick S′, as diagramatically illustrated in FIG. 25. As the wrapped stick S′ and the label L are further advanced within the folding channel 116, the label is folded around the stick to the position generally shown in FIG. 26 to bring one end portion of the label into engagement with the lower end face of the stick S′ and the other end portion thereof designated Y into trailing relation with the upper face of the stick. Since the side edges of the label L do not extend beyond the ends of the wrapped stick S′, no end folding operations are required to apply the label. The fourth rotary folder 110 comprises a pocket wheel 118 carried by a drive shaft 109. The pocket wheel 118 is similar to the pocket wheel 36*a* and is also arranged for continuous rotation and is or may be driven at continuously varying speed, as may be required. The pocket wheel 118 receives a partially labelled stick S′ from the third folding wheel 108 and further advances it along an arcuate path relative to a stationary folder 120. The fourth rotary folder functions to fold the label trailing end portion Y from its solid to its broken line position of FIG. 27 as the wheel 118 rotates relative to the stationary folder 120. The fifth rotary folder 112 comprises another rotary transfer wheel 122 and a plurality of associated stationary plates which define a folding channel 124. The latter channel is arranged to receive sticks from the pocket wheel 118 and communicates with the stacker 19*a*. The fifth rotary folder receives each partially wrapped stick from the folder 110 and folds the label trailing end portion Y inwardly below the lower face of the wrapped stick S′ to complete the label long seam, as shown in FIG. 28. The fifth rotary folder 112 delivers the wrapped and labeled stick to the stacking mechanism 19*a* with the exposed edge of its label long seam, designated Z in FIG. 28, in trailing position.

In FIG. 29 there is shown a modified form of the machine of 10*a* designated at 10*b*. Some parts of the machine 10*b* identical to parts of the previously described machine 10*a* bear the reference numerals of the machine 10*a*. The machine 10*b* has a third rotary folder indicated generally at 108*b*, which completes the long seam of the inner wrapper W, as previously described, and first and second rotary transfer wheels designated generally at 126 and 128 respectively. The third rotary folder 108*b* differs from the previously described rotary folder 108*a* only in the construction and arrangement of the plates which define its folding channel 116b.

The first rotary transfer wheel 126 has no counterpart in the previously described mechanism and comprises a pocket wheel 130 supported for continuous rotation at constant speed and in timed relation with the transfer wheels 114 and 128 by a drive shaft 131. A plurality of plates surround the lower portion of the pocket wheel 130 and cooperate therewith to define a gum stick guide track 132 which communicates with the folding channel 116*b*. The second rotary transfer wheel 128 is similar to the fifth folding wheel 112 previously described in that it includes the rotary element 122. However, the plates which cooperate with the latter element are somewhat differently constructed and arranged and define a gum stick guide track 134 which communicates with the guide track 132 and with the stacking mechanism 19*a*. The second transfer wheel 128 receives wrapped sticks from the first transfer wheel 126 and delivers the wrapped sticks to the stacking mechanism 19*a* in bottom-up condition with the exposed edge of the inner wrapper long seam in trailing position.

It will now be evident that the machine 10*a*, which is set up to discharge wrapped, labelled sticks may also be set up to deliver wrapped, unlabelled sticks. When unlabelled sticks are to be packaged, the fourth rotary folder 110 is removed from the machine and its associated drive mechanism is also removed or otherwise disabled. The plates which define the folding channels 116 and 124 are also removed from the machine 10*a*. The first rotary transfer wheel 126 and the plates which define the folding channel 116*b* and the gum stick guide track 134 are next positioned on the machine.

The machine, now in the form illustrated in FIG. 29, is ready for operation and will deliver each wrapped, unlabeled stick to the stacking mechanism 19a with the long seam of its inner wrapper in trailing position.

I claim:

1. A gum stick wrapping machine comprising a gum stick breaker mechanism including a rotary gum stick transfer mechanism for cntinuously conveying gum sticks away from said breaker mechanism, a first rotary folder including means defining an arcuate first folding channel communicating with said rotary stick transfer mechanism for receiving each successive stick therefrom, a first rotary element journalled for continuous rotation relative to said first folding channel and having a series of circumaxially arranged and radially outwardly extending flights for engaging sticks in said channel to continuously convey the sticks therealong, said first folding channel having first folding means for folding an inner wrapper to a generally U-shaped configuration about a stick advancing therein to fold one end portion of the inner wrapper against the lower face of the stick to bring the other end portion of the inner wrapper into trailing relation with the upper face of the stick and the opposite side marginal portions of the inner wrapper into outwardly extending relation to the opposite ends of the stick, second folding means associated with said first folding channel for engaging and folding the side marginal portions of the inner wrapper downwardly relative to the stick and against the opposite ends thereof and tucking the side marginal portions inwardly toward each other and below the lower face of the stick and into trailing relation with the lower face as the partially wrapped stick is advanced within said folding channel by said first rotary element, third folding means associated with said folding channel for engaging the trailing portions of the inner wrapper and folding the trailing portions of the previously folded and tucked side marginal portions upwardly relative to the stick and against the trailing edge of the stick and into face to face engagement with the lower surface of the trailing upper end portion of the inner wrapper as the partially wrapped stick is continuously advanced within said first folding channel by said first rotary element, and drive means for continuously rotating said first rotary element in timed relation to said breaker mechanism and said gum stick transfer mechanism.

2. A gum stick wrapping machine as set forth in claim 1 wherein said means defining said first folding channel comprises a plate assembly extending around the upper portion of said rotary folding element and having a center of curvature coincident with the axis of said first rotary element.

3. A gum stick wrapping machine as set forth in claim 2 wherein said plate assembly comprises a plurality of axially spaced apart arcuate gum support plates and said flights are disposed to rotate in spaces between said plates.

4. A gum stick wrapping machine as set forth in claim 2 wherein said second folding means comprises spiral folder blocks mounted in fixed positions at opposite sides of said first folding channel for engaging the outwardly extending side marginal portions of the wrapper as the stick advances within said first folding channel.

5. A gum stick wrapping machine as set forth in claim 3 wherein said first folding means comprises said gum support plates.

6. A gum stick wrapping machine as set forth in claim 1 wherein said third folding means comprises a rotary folding and creasing mechanism including opposing wheels journalled for rotation about axes parallel to the axis of said first rotary element.

7. A gum stick wrapping machine as set forth in claim 6 wherein said folding and creasing mechanism comprises a pair of coaxially supported and axially spaced apart creasing wheels driven in timed relation with said first rotary element and disposed at opposite sides of said first folding channel and each of said creasing wheels has a circumaxially spaced series of arcuate peripheral segments defining creasing shoes for engaging trailing marginal portions of wrappers on associated sticks advanced within said first folding channel by said first rotary element.

8. A gum stick wrapping machine as set forth in claim 7 wherein said first rotary element comprises a folding wheel carried by a central shaft journalled on the machine frame, one of said creasing wheels is supported for rotation generally adjacent one side of said first rotary element by one shaft driven by said central shaft, and the other of said creasing wheels is supported for rotation adjacent the other side of said first rotary element by another shaft driven in timed relation to said central shaft.

9. A gum stick wrapping machine as set forth in claim 1 wherein said first rotary folder includes fourth folding means positioned along said arcuate first path between said first and second folding means for engaging the opposite side marginal portions of the wrapper as the stick is advanced within said first folding channel and folding the lower side marginal portions of the wrapper upwardly against the opposite ends of the stick and against the lower face of the upper side marginal portions of the wrapper.

10. A gum stick wrapping machine as set forth in claim 9 wherein said fourth folding means comprises means defining slots at opposite sides of said first folding channel converging in the direction of stick advance for receiving and engaging the outwardly extending side marginal portions of the inner wrapper as the stick advances within said first folding channel.

11. A gum stick wrapping machine as set forth in claim 1 wherein said breaker mechanism has upper and lower toothed breaker wheels supported for rotation about parallel axis to form a nip therebetween and a rotary stick transfer mechanism driven in timed relation with said breaker mechanism and said first rotary folder for conveying gum sticks separated by said breaker mechanism to said rotary folder and comprising a breaker transfer conveyor defining a circular transfer path passing through said nip for receiving sticks separated by said breaker wheels and conveying the sticks away from said nip and along a portion of said transfer path.

12. A gum stick wrapping machine as set forth in claim 11 wherein said breaker transfer conveyor comprises a pair of axially spaced apart rotary transfer members supported at opposite sides of said breaker wheels for coaxial rotation about an axis parallel to and spaced from the axes of said breaker wheels and each of said transfer members has a circumaxially spaced series of gum stick carrier elements thereon arranged in axially opposed relation to the stick carrier elements on the other of said transfer members, said carrier elements generally defining said circular transfer path.

13. A gum stick wrapping machine as set forth in claim 11 wherein said rotary stick transfer mechanism includes a stick transfer wheel communicating with said first folding channel for receiving sticks from said breaker transfer conveyor and conveying the sticks to said first folding channel.

14. A gum stick wrapping machine as set forth in claim 13 wherein said stick transfer wheel comprises a pocket wheel having a circumaxial series of radially outwardly opening stick receiving pockets and means defining an arcuate guide track having a center of curvature generally coincident with the axis of said pocket wheel and generally complementing an associated portion of the periphery of said pocket wheel.

15. A gum stick wrapping machine as set forth in claim 1 wherein said machine includes a second rotary folder for receiving the partially wrapped stick from said first folding channel and conveying it along a second arcuate path and folding the trailing portions of the inner wrapper downwardly relative to the stick and against the trailing edge of the stick as it is advanced along said second path and a third rotary folder for receiving the partially wrapped stick from said second rotary folder and conveying it along a third arcuate path and folding the trailing end portions of the inner wrapper into overlying relation with an associated part of the opposite end portion of the wrapper as it advances along said third path to complete the long seam of the inner wrapper and drive means for continuously rotating said second and third rotary folders in timed relation with said first rotary element.

16. A gum stick wrapping machine as set forth in claim 15 wherein said third rotary folder comprises means for delivering the wrapped stick to the discharge end of said machine with the exposed edge of the long seam in trailing position.

17. A gum stick wrapping machine as set forth in claim 15 wherein said third rotary folder includes a second folding channel including means for folding an outer wrapper to a generally U-shaped configuration about a wrapped stick to fold one end portion of the outer wrapper against an associated portion of the lower face of the wrapped stick and a mid-portion of the outer wrapper against the upper face of the wrapped stick to bring the other end portion of the outer wrapper into trailing relation with the upper face of the wrapped stick as the wrapped stick and outer wrapper are conveyed along said third path.

18. A gum stick wrapping machine as set forth in claim 17 wherein said machine includes a fourth rotary folder for receiving the wrapped stick and outer wrapper from said third rotary folder and folding the trailing other end portion of the outer wrapper against the trailing edge of the wrapped stick and a fifth rotary folder for receiving the wrapped stick and its outer wrapper from the fourth rotary folder and folding the trailing other end portion of said outer wrapper into overlapping relation with an associated part of the one end portion of the outer wrapper to complete the long seam of the outer wrapper and drive means for continuously rotating said fourth and fifth rotary folders in timed relation with said third rotary folder.

19. A gum stick wrapping machine as set forth in claim 18 wherein said fifth rotary folder comprises means for delivering the wrapped stick to the discharge end of the machine with the exposed edge of its outer wrapper long seam in trailing position.

20. A gum stick wrapping machine as set forth in claim 15 wherein said machine includes a stacking mechanism, a first rotary transfer wheel for receiving the wrapped stick from said third rotary folder and advancing it along a generally arcuate path, and a second rotary transfer wheel for receiving the wrapped stick from said first rotary transfer wheel and delivering it to said stacking mechanism with the exposed edge of its outer wrapper long seam in trailing position and drive means for continuously rotating said first and second rotary transfer wheels in timed relation with said second and third rotary folders.

21. A gum stick wrapping machine as set forth in claim 15 wherein said second rotary folder comprises a pocket wheel having a plurality of radially outwardly diverging stick receiving pockets and said drive means comprises means for driving said second rotary folder at continuously varying speed.

22. A gum stick wrapping machine as set forth in claim 18 wherein said fourth rotary folder comprises a pocket wheel having a plurality of radially outwardly diverging stick receiving pockets and said drive means comprises means for driving said fourth rotary folder at continuously varying speed.

23. In a gum stick wrapping machine having a gum stick breaker mechanism including a toothed lower breaker wheel supported on a first shaft and journalled for rotation in one direction about a horizontally disposed axis and a toothed upper breaker wheel supported on a second shaft and journalled for rotation in a direction opposite said one direction about an axis parallel to the axis of the upper breaker wheel, the upper and lower breaker wheels being arranged in interdigitating relation to define a nip therebetween, and a transfer conveyor for receiving sticks separated by said breaker wheels and conveying the sticks along a transfer path and away from the nip, the improvement comprising said transfer conveyor having a pair of axially spaced apart rotary members supported for coaxial rotation about an axis below said breaker wheels and parallel to the axis of said lower breaker wheel with said lower breaker wheel disposed generally between said rotary members, each of said rotary members having a circumaxially spaced series of gum stick carrier elements mounted thereon and opposing said gum stick carrier elements on the other of said rotary members, said carrier elements on said members cooperating to define a circular transfer path passing through said nip, said rotary members including a ring gear and another rotary member, a third shaft extending coaxially through said ring gear and supporting said other rotary member for rotation about its axis, a pinion drivingly engaging teeth on a peripheral portion of said ring gear for driving said ring gear in said one direction, and means for rotating said third shaft in said one direction in timed relation to said ring gear.

24. The combination as set forth in claim 23 including a plurality of rollers engaging a peripheral surface of said ring gear to support said ring gear for rotation about its axis.

25. The combination as set forth in claim 24 wherein said rollers engage the inner peripheral surface of said ring gear and said pinion intermeshingly engages teeth on the outer periphery of said ring gear.

26. The combination as set forth in claim 23 including means defining an arcuate guide track generally complementing an associated portion of said circular transfer path for containing gum sticks conveyed away from said nip by said transfer conveyor.

* * * * *